US006146017A

United States Patent [19]

Hodges

[11] Patent Number: 6,146,017

[45] Date of Patent: Nov. 14, 2000

[54] PLASTIC BAGS HAVING THROUGH BORES FOR EASY OPENING

[76] Inventor: William S. Hodges, 444 Saratoga Ave., Apt. 41G, Santa Clara, Calif. 95050

[21] Appl. No.: 09/340,591

[22] Filed: Jun. 28, 1999

[51] Int. Cl.[7] ..... B65D 33/00

[52] U.S. Cl. ..... 383/35; 206/390; 383/37; 383/120

[58] Field of Search ..... 383/35, 37, 120, 383/103; 206/390, 554

[56] References Cited

U.S. PATENT DOCUMENTS

| | | | |
|---|---|---|---|
| 2,391,938 | 1/1946 | Baker | 383/80 X |
| 2,790,591 | 4/1957 | Rosen | 206/554 X |
| 3,254,828 | 6/1966 | Lerner | 383/37 |
| 3,646,723 | 3/1972 | Meroney | 206/554 X |
| 3,966,524 | 6/1976 | Lehmacher | 206/390 X |
| 3,979,050 | 9/1976 | Cilia | 206/390 X |
| 4,171,048 | 10/1979 | Ernst . | |
| 4,305,503 | 12/1981 | Membrino | 206/554 |
| 4,714,191 | 12/1987 | Richardson . | |
| 4,811,418 | 3/1989 | Reifenhauser | 206/554 X |
| 5,184,896 | 2/1993 | Hammond et al. | 383/120 X |
| 5,207,368 | 5/1993 | Wilfong, Jr. et al. . | |
| 5,573,168 | 11/1996 | Kannankeril et al. . | |
| 5,706,993 | 1/1998 | De Matteis . | |

FOREIGN PATENT DOCUMENTS

| | | | |
|---|---|---|---|
| 1233455 | 10/1960 | France | 383/35 |
| 7801075 | 9/1978 | Netherlands | 383/103 |
| 183216 | 6/1936 | Switzerland | 383/35 |
| 1652207 | 5/1991 | U.S.S.R. | 383/35 |
| 1822842 | 6/1993 | U.S.S.R. | 383/35 |
| 751339 | 6/1956 | United Kingdom | 383/35 |
| 1204462 | 9/1970 | United Kingdom | 383/103 |
| 93/11050 | 6/1993 | WIPO | 206/390 |

*Primary Examiner*—Stephen K. Cronin
*Assistant Examiner*—Robin A. Hylton

[57] ABSTRACT

Easy open, plastic bags for dispensing from either a roll or a carton that include a plurality of easy open, plastic bags formed by a pair of overlying sheets. Each bag has an expandable gusset near one end thereof. The one end of each bag is respectively connected to a filling end of the next bag, by detaching perforations. Each bag further has a plurality of throughbores that are aligned and extend thereacross for facilitating opening thereof. The plurality of throughbores in each bag are disposed parallel to, and slightly inward of, the detaching perforations of a respective bag. The plurality of throughbores in each bag extend through either only one sheet of the pair of sheets, both sheets of the pair of sheets and in alignment with each other, both sheets of the pair of sheets and offset from but touching each other, or both sheets of the pair of sheets and offset from and not touching each other.

2 Claims, 1 Drawing Sheet

PLASTIC BAGS HAVING THROUGH BORES FOR EASY OPENING

BACKGROUND OF THE INVENTION

1. Field of the Invention

The present invention relates to plastic bags. More particularly, the present invention relates to easy open, plastic bags.

2. Description of the Prior Art

Numerous innovations for bag related devices have been provided in the prior art that will be described. Even though these innovations may be suitable for the specific individual purposes to which they address, however, they differ from the present invention.

FOR EXAMPLE, U.S. Pat. No. 4,171,048 to Ernst teaches a plurality of expandable bags serially connected lengthwise in roll form. Each bag is of substantially long length and has an expandable gusset near one end thereof and transversely of the length. The gusset end of each bag is respectively connected to the filling or open end of the next bag by perforated or weakened structure. Various modifications of the position of the opening are incorporated. Also, the bags are rolled into serial form in a compact package for distribution and use with the gusset and opening portions of each bag being rolled inwardly to the inside of the roll, or outwardly to the outside of the roll. The method of making these serially connected bags in roll form is also included.

ANOTHER EXAMPLE, U.S. Pat. No. 4,714,191 to Richardson teaches a one piece paperboard carton blank folded into a rectangular shape for packaging and dispensing from a roll of individual plastic bags, particularly disposable milk bottles for feeding babies. The carton has a double wall front part which includes an inner top rigidly supporting a tab protruding in a direction opposite to the direction of withdrawal of bags from the roll. When a first plastic bag is withdrawn it starts to pull out a succeeding bag to which it is removably attached along a line of perforations. When the center of the perforated edge of the succeeding bag is impaled on the tab, further withdrawal of the succeeding bag is restrained and the first bag is readily separated to facilitate its dispensing and to place the leading edge of the succeeding bag where it may be easily reached for withdrawal.

STILL ANOTHER EXAMPLE, U.S. Pat. No. 5,207,368 to Wilfong, Jr. et al. teaches a dispensing apparatus for serially dispensing flexible plastic bags from a wound package of bags which are joined along perforated severance lines, including a panel, and at least one elongate dispensing slot extending through the panel. The slot includes relatively narrow and linearly aligned outer edge portions, and a laterally extending tongue positioned between the outer edge portions. Also, an opening is located on one side of the tongue. In use, the opening is used to facilitate thread-up of the initial bag through the slot, and the two outer edge portions serve to engage and hold the bag in the slot. During withdrawal, the tongue engages the central portion of the bag, and when the tongue engages the next perforated severance line, or the bottom of the cut out in the case of T-shirt bags, a significant resistance is imparted which causes the severance line to rupture, with the next bag positioned in the slot and ready to be engaged and withdrawn.

YET ANOTHER EXAMPLE, U.S. Pat. No. 5,573,168 to Kannankeril et al. teaches a dispensing apparatus for serially dispensing plastic bags from a wound roll of continuous flexible plastic bags joined along perforated severance lines.

A box like container is provided which is adapted to receive the wound roll of plastic bags. The container has a bottom panel, a top panel, a rear panel, and a pair of opposed side panels. The front panel defines a guide slot for guiding the plastic bags from the wound roll along a predetermined path and further defining a threading slide for threading the plastic bags from the wound roll into the guide slot. A separation tongue is located on the front panel for separating the plastic bags from the wound roll as the plastic bags engage the separation tongue along a predetermined path of travel.

FINALLY, STILL YET ANOTHER EXAMPLE, U.S. Pat. No. 5,706,993 to DeMatteis teaches a dispenser for a roll of bags joined in series end-to-end along transverse severable lines comprising a receptacle in which a roll of bags may be held and rotated to pass the bags through the outlet of the receptacle and a web guide secured to the outlet. The web guide may be provided with a floor and inwardly overhanging side edges with the floor terminating in an upwardly projecting serrated edge which effects separation of each bag from its next ensuing bag.

It is apparent that numerous innovations for bag related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide easy open, plastic bags that avoid the disadvantages of the prior art.

ANOTHER OBJECT of the present invention is to provide easy open, plastic bags that are simple and inexpensive to manufacture.

STILL ANOTHER OBJECT of the present invention is to provide easy open, plastic bags that are simple to use.

BRIEFLY STATED, YET ANOTHER OBJECT of the present invention is to provide a easy open, plastic bass for dispensing from either a roll or a carton that include a plurality of easy open, plastic bags formed by a pair of overlying sheets. Each bag has an expandable gusset near one end thereof. The one end of each bag is respectively connected to a filling end of the next bag, by detaching perforations. Each bag further has a plurality of throughbores that are aligned and extend thereacross for facilitating opening thereof. The plurality of throughbores in each bag are disposed parallel to, and slightly inward of, the filling end. The plurality of throughbores in each bag extend through either only one sheet of the pair of sheets, both sheets of the pair of sheets and in alignment with each other, both sheets of the pair of sheets and offset from but touching each other, or both sheets of the pair of sheets and offset from and not touching each other.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
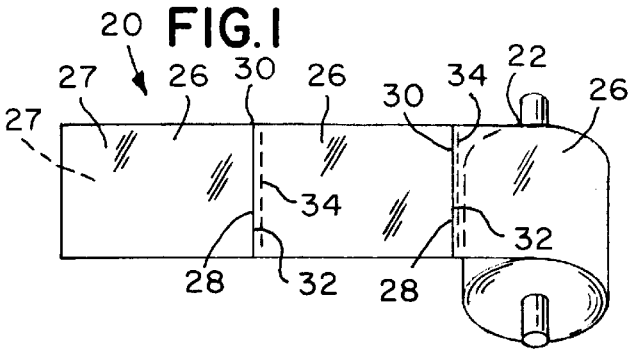
FIG. 1 is a diagrammatic perspective view of the present invention dispensing from a roll.

20 easy open, plastic bags of the present invention for dispensing from one of roll 22 and carton 24
22 roll
24 carton
26 plurality of easy open, plastic bags 26
27 pair of overlying sheets of plurality of easy open, plastic bags 26
28 expandable gusset near one end 30 of each bag of plurality of easy open, plastic bags 26
30 one end of each bag of plurality of easy open, plastic bags 26
32 filling end of each bag of plurality of easy open, plastic bags 26
34 detaching perforations
36 plurality of throughbores extending across each bag of plurality of easy open, plastic bags 26 for facilitating opening thereof

DESCRIPTION OF THE PREFERRED EMBODIMENT

Figure 2:
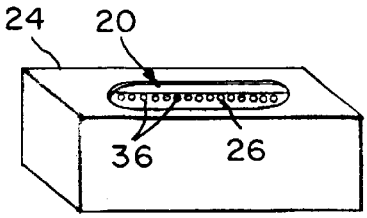
FIG. 2 is a diagrammatic perspective view of the present invention dispensing from a carton.

Referring now to the figures, in which like numerals indicate like parts, and particularly to FIGS. 1 and 2, respectively, the easy open, plastic bags of the present invention are shown generally at 20 for dispensing from one of a roll 22 and a carton 24.

The general configuration of the easy open, plastic bags 20 can best be seen in FIGS. 1 and 2, and as such, will be discussed with reference thereto.

The easy open, plastic bags 20 comprise a plurality of easy open plastic bags 26 connected lengthwise to each other, and formed by a pair of overlying sheets 27.

Each bag of the plurality of easy open, plastic bags 26 has an expandable gusset 28 near one end 30 thereof and transversely of its length.

The one end 30 of each bag of the plurality of serially connected easy open, plastic bags 26 is respectively connected to a filling end 32 of the next bag of the plurality of serially connected easy open, plastic bags 26, by detaching perforations 34.

Each bag of the plurality of easy open, plastic bags 26 further has a plurality of throughbores 36 that are aligned and extend thereacross for facilitating the opening thereof.

The plurality of throughbores 36 in each bag of the plurality of easy open, plastic bags 26 are disposed parallel to, and slightly inward of, the detaching perforations 34 of a respective bag of the plurality of easy open, plastic bags 26, and through at least one sheet of the pair of sheets 27 of the plurality of easy open, plastic bags 26.

Figure 3:
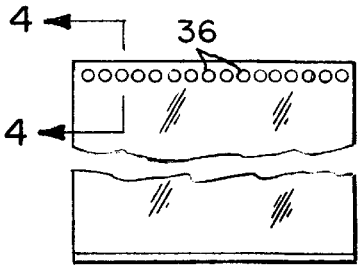
FIG. 3 is a diagrammatic front elevational view of a first embodiment of the present invention.
Figure 4:
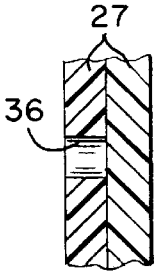
FIG. 4 is a cross sectional view taken on line 4—4 in FIG. 3.

The first embodiment of the position of the plurality of throughbores 36 in each bag of the plurality of easy open, plastic bags 26 can best be seen in FIGS. 3 and 4, and as such, will be discussed with reference thereto.

The plurality of throughbores 36 in each bag of the plurality of easy open, plastic bags 26 extend through only one sheet of the pair of sheets 27 of the plurality of easy open, plastic bags 26.

Figure 5:
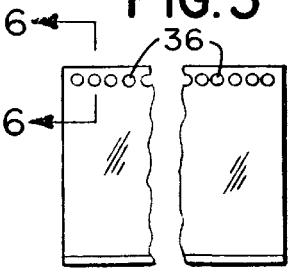
FIG. 5 is a diagrammatic front elevational view of a second embodiment of the present invention.
Figure 6:
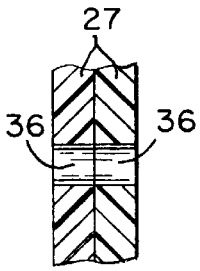
FIG. 6 is a cross sectional view taken on line 6—6 in FIG. 5.

The second embodiment of the position of the plurality of throughbores 36 in each bag of the plurality of easy open, plastic bags 26 can best be seen in FIGS. 5 and 6, and as such, will be discussed with reference thereto.

The plurality of throughbores 36 in each bag of the plurality of easy open, plastic bags 26 extend through both sheets of the pair of sheets 27 of the plurality of easy open, plastic bags 26, in alignment with each other.

Figure 7:
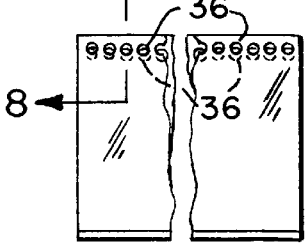
FIG. 7 is a diagrammatic front elevational view of a third embodiment of the present invention.
Figure 8:
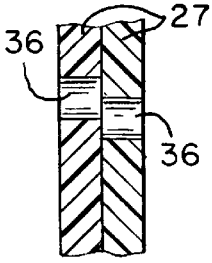
FIG. 8 is a cross sectional view taken on line 8—8 in FIG. 7.

The third embodiment of the position of the plurality of throughbores 36 in each bag of the plurality of easy open, plastic bags 26 can best be seen in FIGS. 7 and 8, and as such, will be discussed with reference thereto.

The plurality of throughbores 36 in each bag of the plurality of easy open, plastic bags 26 extend through both sheets of the pair of sheets 27 of the plurality of easy open, plastic bags 26, offset from, but touching, each other.

Figure 9:
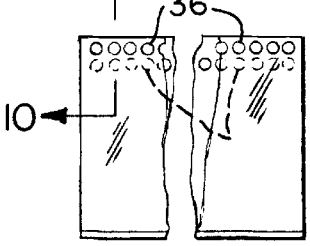
FIG. 9 is a diagrammatic front elevational view of a fourth embodiment of the present invention.
Figure 10:
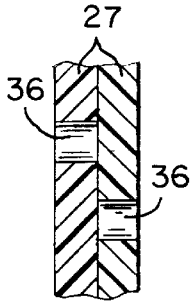
FIG. 10 is a cross sectional view taken on line 10—10 in FIG. 9.

The fourth embodiment of the position of the plurality of throughbores 36 in each bag of the plurality of easy open, plastic bags 26 can best be seen in FIGS. 9 and 10, and as such, will be discussed with reference thereto.

The plurality of throughbores 36 in each bag of the plurality of easy open, plastic bags 26 extend through both sheets of the pair of sheets 27 of the plurality of easy open, plastic bags 26, offset from, and not touching, each other.

Figure 11:
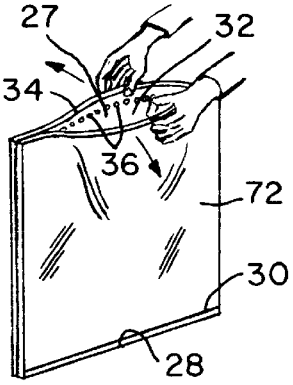
FIG. 11 is a diagrammatic perspective view of the present invention being opened.

As shown in FIG. 11, opening of the filling end 32 of a respective bag of the plurality of easy open, plastic bags 26 is facilitated by the presence of the plurality of throughbores 36 thereof.

It will be understood that each of the elements described above, or two or more together, may also find a useful application in other types of constructions differing from the types described above.

While the invention has been illustrated and described as embodied in easy open plastic bags, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. Plastic bags, comprising a plurality of easy open, plastic bags formed by a pair of overlying sheets; one end of each bag of said plurality of easy open, plastic bags being respectively connected to a filling end of the next bag of said plurality of easy open, plastic bags, by detaching perforations; each bag of said plurality of easy open, plastic bags further having a plurality of throughbores aligning and extending thereacross for facilitating opening thereof; said plurality of throughbores in each bag of said plurality of easy open, plastic bags extending through only one sheet of said pair of sheets of said plurality of easy open, plastic bags.

2. The bags as defined in claim 1, wherein said plurality of throughbores in each bag of said plurality of easy open, plastic bags are disposed parallel to, and slightly inward of, said filling end of a respective bag of said plurality of easy open, plastic bags, and through at least one sheet of said pair of sheets of said plurality of easy open, plastic bags.

* * * * *